US005900563A

United States Patent [19]

Leonard

[11] Patent Number: 5,900,563

[45] Date of Patent: May 4, 1999

[54] COMPACT ROTARY VALVE FOR BRASS INSTRUMENTS

[76] Inventor: Brian Phillip Leonard, 1849 Brookfield Dr., Akron, Ohio 44313

[21] Appl. No.: 08/662,035

[22] Filed: Jun. 12, 1996

[51] Int. Cl.[6] ..... G10D 9/04

[52] U.S. Cl. ..... 84/390; 84/389

[58] Field of Search ..... 84/388, 389, 390, 84/393

[56] References Cited

U.S. PATENT DOCUMENTS

| | | | |
|---|---|---|---|
| 2,608,899 | 9/1952 | Lisi et al. | 84/388 |
| 3,494,242 | 2/1970 | Kurokawa et al. | 84/389 |
| 3,631,755 | 1/1972 | Glantz | 84/388 |
| 3,641,863 | 2/1972 | Kanstul et al. | 84/390 |
| 3,881,388 | 5/1975 | McCracken | 84/388 |
| 4,095,504 | 6/1978 | Hirsbrunner | 84/390 |
| 4,112,806 | 9/1978 | Thayer | 84/390 |
| 4,213,371 | 7/1980 | Thayer | 84/390 |
| 4,299,156 | 11/1981 | Thayer | 84/390 |
| 4,336,738 | 6/1982 | Alexander | 84/390 |
| 4,469,002 | 9/1984 | Thayer | 84/390 |
| 4,685,372 | 8/1987 | Kawasaki | 84/392 |
| 4,696,454 | 9/1987 | Hamanaga | 251/321 |
| 4,718,318 | 1/1988 | Boy | 84/390 |
| 4,905,564 | 3/1990 | Thayer | 84/390 |
| 4,970,932 | 11/1990 | Hamanaga | 84/390 |
| 4,972,751 | 11/1990 | Kuno | 84/390 |
| 5,361,668 | 11/1994 | Andersen et al. | 84/392 |
| 5,396,825 | 3/1995 | Kirts | 84/390 |
| 5,686,678 | 11/1997 | Greenhoe | 84/390 |

OTHER PUBLICATIONS

"New Bach® Balanced Valve Trombones", The Selmer Company advertisement, 1 page (Spring 1994).

"Holton's new trombone 'Monster Valve' is so innovative, it's patented", Leblanc Corporation advertisement, 1 page (Spring 1995).

"Layout Guide for Axial–Flow Valve Installation of In–Line Bass Trombone", O.E. Thayer, 1 page (Sep. 1984).

"Posaunen Modell Rotax®—Rotax® trombones—Trombone modele Rotax®", Wilson Band Instruments advertisement, 2 pages (undated).

"Tenor trombones, large bore—Holton", Leblanc Corporation advertisement, 1 page (undated).

"The new Rotax® cylinder rotors", advertisement appearing in *International Trombone Association Journal*, 1 page (undated).

"Transcendent Tone & Playability", Yamaha Corporation advertisement, 1 page (undated).

"Yamaha French Horns", Yamaha Corporation advertisement, 8 pages (undated).

*Primary Examiner*—William M. Shoop, Jr.
*Assistant Examiner*—Shih-yung Hsieh
*Attorney, Agent, or Firm*—Renner, Kenner, Greive, Bobak, Taylor & Weber

[57] ABSTRACT

A rotary valve (10) for a brass wind instrument includes a rotor (12) rotatably disposed in a casing (30). Four tube connecters (50) are connected to the casing in fluid-tight connections. Each tube connecter (50) has a passageway (52) therethrough having a constant, circular cross section. The rotar (12) has two ducts (14, 16) therethrough, each having a constant, circular cross section with a diameter (18) equal to the diameter of the passageways (52) through the tube connecters (50). The rotor (12) is selectively rotatable between an unactuated position and an actuated position. When the rotor (12) is in the unactuated position, a single soundpath (70) is formed through the valve. The single soundpath (70) has limited curvature and has a constant diameter. When the rotor (12) is in the actuated position, two soundpaths (72, 74) are formed through the valve (10). The first of the two soundpaths (72) subjects the sound to only a single 45 degree turn through the valve.

11 Claims, 4 Drawing Sheets

COMPACT ROTARY VALVE FOR BRASS INSTRUMENTS

TECHNICAL FIELD

The present invention relates generally to musical instruments. More particularly, the present invention relates to valves for brass wind instruments. Specifically, the present invention relates to rotary valves for brass wind instruments.

BACKGROUND OF THE INVENTION

Brass instruments such as French horns, trombones, tubas, trumpets, and the like, typically include a flared bell connected to a mouthpiece by at least one length of hollow tubing. The tone of the sound produced by the instrument depends, in part, on the length of the tubing connecting the mouthpiece to the bell. Thus, the tone of the sound produced by the musical instrument may be changed by altering the length of the tubing between the bell and the mouthpiece. With the exception of the slide trombone, the addition of tubing length is accomplished by adding loops of tubing that may be selectively activated by use of valves. There are several types of valves used on brass instruments, the most common being piston valves and rotary valves of varying specific designs.

A slide trombone typically includes a mouthpiece that is connected to a bell with tubing having an adjustable section referred to as a handslide. The handslide permits the musician to selectively and continuously vary the length of the connecting tubing while he plays the instrument. To create a tone having lower pitch, the musician increases the length of the tube by pushing the handslide away from himself. Conversely, the musician pulls the handslide back to decrease the length of the tubing creating a higher pitch tone. Musical pieces that require rapid changes between high notes and low notes are more difficult to play because of the required rapid, and accurate, manipulation of the handslide over relatively large distances. To decrease the distances between notes, additional sections of tubing may be added to the instrument and to extend the low register range. The additional loops are selectively incorporated into the active length of tubing by valves.

Rotary valves are among the numerous types of valves used to add and subtract the additional loop into and out of the active length of tubing. Rotary valves generally include a rotor that may be selectively rotated inside a casing. Two air ducts are typically disposed in the rotor. The tubes of the instrument are connected to the casing such that the air ducts inside the rotor may selectively form different soundpath configurations for the instrument. A soundpath is defined by the configuration of the tubing of the instrument. One undesirable aspect of known rotary valves is that the cross section of the tubing does not remain constant through the valve, thus increasing the acoustic impedance of the instrument.

Acoustic impedance degrades the quality of the musical tones produced by the musical instrument by adversely effecting the sound waves as they pass through the instrument. Acoustic impedance generally increases as the length of the tubing used to produce the sound increases. The surface and shape of the tubing also adversely effects acoustic impedance. Generally, the level of acoustic impedance increases as the number of serpentine turns in the tubing increases and as the radii of the turns decreases. Transitions between tubing sections of different cross sections or diameter are another factor that increases the acoustic impedance. Abrupt or sharp transitions generally have a higher level of impedance than smooth transitions.

One rotary valve disclosing a duct configuration having variable tubing cross sections is disclosed by U.S. Pat. No. 4,095,504 to Hirsbrunner. Each passageway through the rotor of the valve is generally D-shaped while the tubing of the instrument is circular. Furthermore, the connections between the rotor ducts (14 and 15) and the duct connectors (4, 5, 6, and 7) are not smooth and undesirably restrict airflow therethrough. The soundpaths created by the valve exhibit the undesirable sharp transitions, non-constant cross sections, and tight turns that increase acoustic impedance.

One valve that solves the problems of tight turns and abrupt transitions is disclosed by U.S. Pat. No. 5,361,668 to Anderson et al. The Anderson valve includes a rotor having three passageways therethrough. Two of these passageways are straight while the third is in the shape of a flattened 'S'. As described in the specification, the Anderson valve affords "straight through" airflow when the valve is in the position where it adds the extra length of tubing. The "straight through" airflow design creates less resistance for the musician while he plays low notes. A problem with the Anderson valve is that the third passageway used to accomplish the "straight through" design causes the overall dimensions of the valve to be too large to be favored by musicians and instrument designers. One limitation of the Anderson valve is that it is specifically designed for a trombone with one or two attachments. Its relatively large physical size makes it too cumberson to be used on other brass instruments such as French horns, euphoniums, tubas, and the like.

SUMMARY OF THE INVENTION

It is, therefore, a primary object of the present invention to provide a rotary valve having reduced acoustic impedance for a brass wind instrument.

It is another object of the present invention to provide a rotary valve, as above, having constant-diameter soundpaths.

It is a further object of the present invention to provide a rotary valve, as above, wherein the soundpaths through the valve have minimal curvature for limiting the acoustic impedance.

It is still another object of the present invention to provide a rotary valve, as above, having overall dimensions generally compatible with conventional tubing configurations.

It is yet another object of the present invention to provide a rotary valve, as above, providing minimal air flow resistance.

It is still a further object of the present invention to provide a rotary valve, as above, that accomplishes the objects of the invention with a rotor having only two ducts.

It is another object of the present invention to provide a rotary valve, as above, that may be incorporated into a variety of different brass instruments.

It is yet another object of the present invention to provide a rotary valve, as above, wherein a plurality of valves may be attached in series to permit multiple attachments having smooth airflow passages.

These and other objects of the invention, as well as the advantages thereof over existing and prior art forms, which will be apparent in view of the following detailed specification, are accomplished by means hereinafter described and claimed. In general, a rotary valve according to the present invention utilizes a casing; a rotor selectively, rotatably disposed in the casing; the rotor having two ducts therethrough; each duct having a constant, circular cross section, four tube connectors attached to the casing, each tube connector having a passageway therethrough; each passageway having a constant, circular cross section with a diameter equal to the diameter of the ducts, the ducts being configured to form a single soundpath having minimal curvature through the valve when the rotor is in an unactuated position and two soundpaths having minimal curvature through the valve when the rotor is in the actuated position.

To acquaint persons skilled in the art most closely related to the present invention, one preferred embodiment of a rotary valve is described herein by, and with reference to, the annexed drawings that form a part of the specification. The exemplary rotary valve is described in detail without attempting to show all of the various forms and modification in which the invention might be embodied. As such, the embodiment shown and described herein is illustrative, and as will become apparent to those skilled in the art can be modified in numerous ways within the spirit and scope of the invention; the invention being defined by the appended claims and their equivalent embodiments.

DESCRIPTION OF AN EXEMPLARY EMBODIMENT

Figure 1:
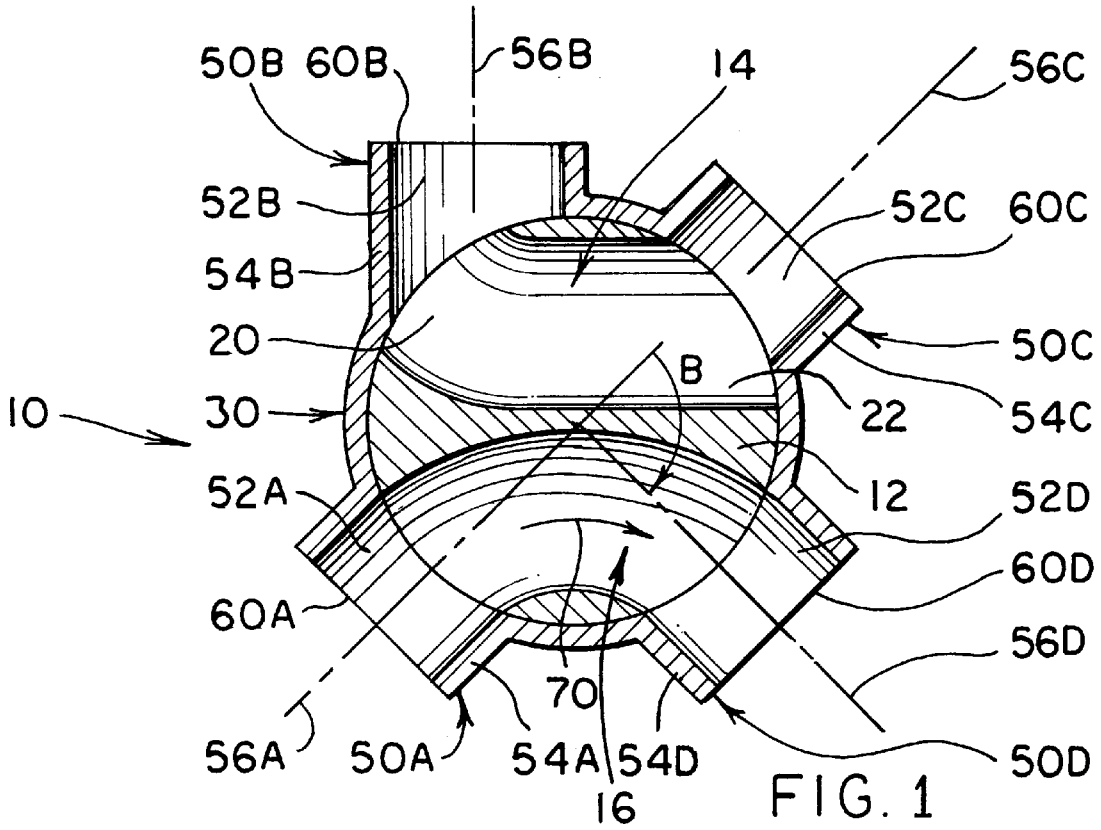
FIG. 1 is a cross sectional side view of a rotary valve according to the present invention, the valve being depicted in the unactuated position.

One representative form of a rotary valve according to the present invention is designated generally by the numeral 10 on the accompanying drawings. The valve 10 includes a rotor 12 having a first duct 14 and a second duct 16 passing therethrough. Each duct 14 and 16 has a constant, circular cross section having a diameter indicated by the numeral 18. The first duct 14 has a curved portion 20 that turns the duct 14 approximately 45 degrees, as indicated by the letter A on the drawings, and connects smoothly with a straight portion 22. The second duct 16 is continuously curved and turns 90 degrees, as indicated by the letter B on the drawings.

Figure 3:
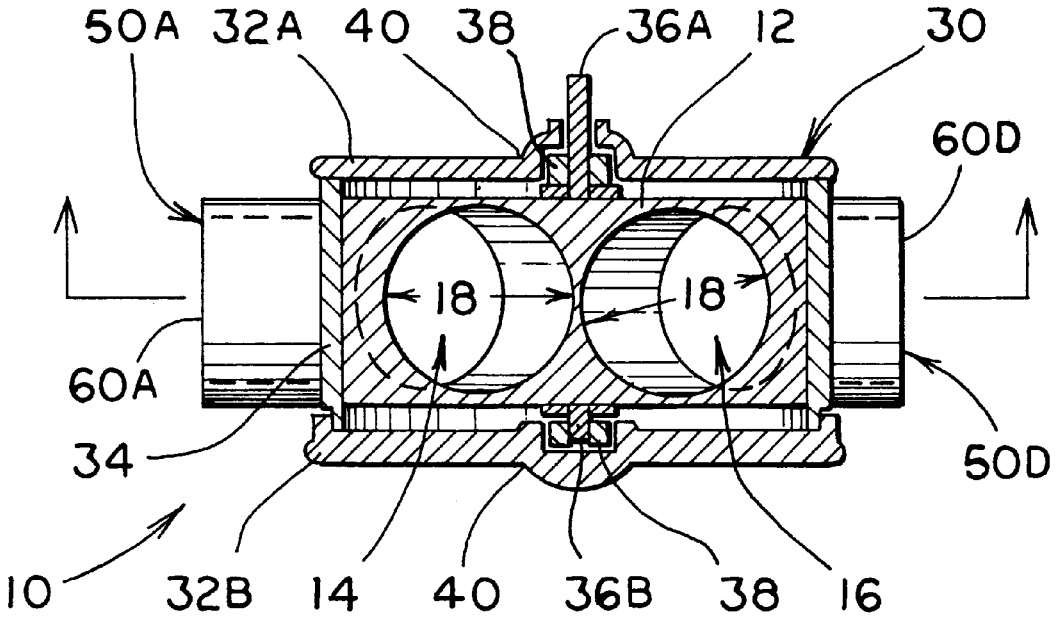
FIG. 3 is a cross sectional plan view of the rotary valve taken substantially along line 3—3 of FIG. 2, the valve being in the actuated position.

The rotor 12 is rotatably disposed in a generally cylindrical casing 30. The casing 30 includes generally disk-shaped first end wall 32A and second end wall 32B, connected to a generally cylindrical sidewall 34. The rotor 12 is connected to a first pin 36A and a second pin 36B. The pins 36 are located on a common axis about which the rotor 12 may be selectively rotated. The mechanism for selectively rotating the rotor 12 may be one of the many that are known in the art and thus is not described in this specification. Each pin 36 may rest directly against the end walls 32, or may rotate against suitable bearings 38 as shown in FIG. 3. Each end wall 32 has a cavity 40 disposed therein configured to accept the bearings 38.

As may be observed in the previous paragraph, a particular structural member, component or arrangement may be employed at more than one location. When referring generally to that type of structural member, component or arrangement, a common numerical designation shall be employed. However, when one of the structural members, components or arrangements so identified is to be individually identified, it shall be referenced by virtue of a letter suffix employed in combination with the numerical designation employed for general identification of that structural member, component or arrangement. Thus, there at least two end walls which are generally identified by the numeral 32, but the specific, individual end walls are, therefore, identified as 32A and 32B in the specification and the drawings. This same suffix convention shall be employed throughout the specification.

Four tube connectors 50A–D are disposed about the circumference of the casing 30. The tube connectors 50 allow the valve 10 to be connected to the various tubes (not shown) of a brass instrument that are used to produce the sound. Each tube connector 50 is connected to the casing 30 in a fluid-tight connection, such as a continuous weld. Each tube connector 50 has a passageway 52 therethrough, defined by the sidewall 54 of the connector 50. Each passageway 52 passes through the sidewall 34 of the casing 30 where the tube connectors 50 are connected to the casing. The casing 30 and the rotor 12 are each configured such that a fluid-tight connection is formed between a passageway 52 and a duct 14 or 16 when the rotor 12 is positioned to align a duct 14 or 16 with a passageway 52. Each passageway 52 has a constant, circular cross section having the same diameter 18 as the ducts 14 and 16 in the rotor 12.

The configuration of the tube connectors 50 varies depending on the type of instrument in which the valve 10 is incorporated. In the embodiment of the present invention depicted in FIGS. 1–3, each tube connector 50 has a straight sidewall 54. The centerline 56A of the first tube connectors 50A forms an approximate 90 degree angle with the centerline 56D of the fourth tube connector 50D. Similarly, the centerline 56C of the third tube connector 50C forms an approximate 90 degree angle with the centerline 56D of the fourth tube connector 50D. Thus, the centerlines 56A and 56C of the first 50A and third 50C tube connectors are essentially parallel. Although the second tube connector 50B connects with the casing 30 approximately 90 degrees from the first tube connector 50A, the second tube connector 50B extends away from the casing such that the centerline 56B of the second tube connector 50B forms an approximate 135 degree angle with the centerline 56A of the first tube connector 50A, thus causing the duct 14 to turn only 45 degrees. The disposition of the tube connectors 50 remains the same even when tube connectors 150 having curved sidewalls 154 are used as shown in FIGS. 4–7.

Each tube connector 50 has a generally planar port 60 where the passageway 52 passes through the end of the tube connector 50. Each port 60 is essentially perpendicular to its respective centerline 56. Thus, the first port 60A is essentially parallel to the third port 60C and both the first 60A and third 60C ports are essentially perpendicular to the fourth port 60D. Furthermore, the second port 60B is essentially disposed at a 45 degree angle to each of the other ports 60A, 60B and 60C. When the valve 10 is typically installed, the first 60A and third 60C ports function as inlet ports while the second 60B and fourth 60D ports function as outlet ports.

The valve 10 may be installed in a brass instrument such as a trombone. Tenor and alto trombones typically include a single valve while tenor-bass and bass trombones typically include two valves connected in series. Such a configuration may be seen in FIGS. 4–7. Other instruments such as trumpets; alto, tenor, and baritone horns; single French horns; euphoniums; and tubas typically include three valves. Other instruments may include four or five valves connected in series. In all of these instruments, smooth air flow passages through the instrument are important in order to produce high quality tones.

In order to describe the operation of the valve 10, it will now be assumed that the valve 10 is installed such that the air and sound are traveling from the mouthpiece (not shown) and are entering the valve through the first port 60A. The fourth port 60D is assumed to be connected to a tube (also not shown) that leads to the bell (also not shown) of the instrument or to the entrance of another valve 110 as shown in FIGS. 4–7. The second port 60B is connected to an extension tube that provides additional tubing length to the instrument and connects back to the third port 60C.

The second duct 16 is configured, as described above, to connect the first passageway 52A with the fourth passageway 52D when the rotor 12 is in the unactuated position depicted in FIG. 1. The combination of the first passageway 52A with the second duct 16 and the fourth passageway 52D is referred to as the single soundpath 70 formed through the valve 10 in the unactuated position. The first duct 14, the second passageway 52B, and the third passageway 52C are not a part of the soundpath when the valve is in the unactuated position. Thus, in the unactuated position, sound enters the valve 10 from the first port 60A and exits through the fourth port 60D. The continuously curved nature of the second duct 16 causes the sound to experience a single 90 degree turn that does not seriously degrade the quality of the sound. The single soundpath 70 also has a constant circular cross section and does not include any sharp edges or abrupt changes in diameter or volume.

Figure 2:
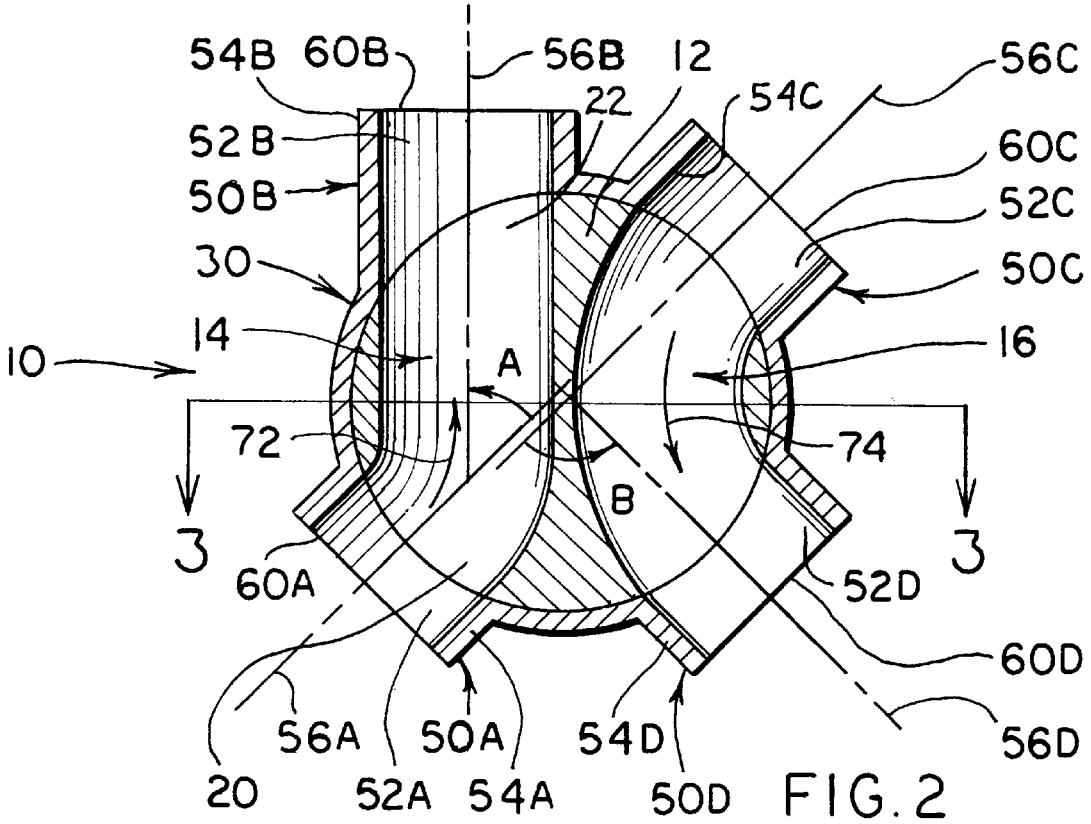
FIG. 2 is a cross sectional side view of a rotary valve according to the present invention, the valve being depicted in the actuated position.

In the actuated position, the valve 10 is designed to add an extension tube into the instrument's soundpath for the purpose of increasing the length of the column of air used to produce the sound. In the actuated position, the valve 10 forms two soundpaths 72 and 74 as shown in FIG. 2. The first actuated soundpath 72 is formed by the connection of the first passageway 52A with the second passageway 52B by the first duct 14. The first actuated soundpath 72 subjects the sound waves traveling therethrough to a single 45 degree turn. Unlike some valves known in the art, the turn is smooth because of the continuous sidewalls. It is also somewhat common in known valves to turn the first actuated soundpath a full 90 degrees. In some known valves, the first actuated soundpath completes a full 180 degree turn. Such a configuration unnecessarily increases the acoustic impedance of the valve. The lack of unnecessary turns in the first actuated soundpath 72 and the constant tube diameters cause the valve 10 to have a lower acoustic impedance than it would have if the first actuated soundpath 72 turned the sound a full 90 degrees.

The second duct 16, which is configured to form the single unactuated soundpath 70, is also configured to form the second actuated soundpath 74. The second actuated soundpath 74 is formed by the connection of the third passageway 52C and fourth passageway 52D with the second duct 16. The second actuated soundpath 74 subjects the sound to a single 90 degree turn. As in the first actuated soundpath 72, the second actuated soundpath 74 is essentially continuous having no abrupt transitions, changes in diameter or tight turns.

When a musician is playing an instrument employing a valve 10 according to the present invention, the higher notes are played with the rotor 12 residing in the unactuated position. Thus, the sound produced by the musician and the instrument travels through the single unactuated soundpath 70. When the musician desires to play lower notes, he actuates the valve 10 by triggering the appropriate mechanism to rotate the rotor 12 by approximately 90 degrees to the actuated position, thus forming the two actuated soundpaths 72 and 74. When the musician is playing the lower notes through the extra length of tubing, it is especially important to decrease the resistance of the valve felt by the musician because the extra length of tubing adds its own resistance. Thus, in addition to the constant diameter of soundpaths 72 and 74, the first actuated soundpath 72 has been straightened.

Multiple valves 10 may be connected to provide an instrument with a wider range of tones. One such configuration of two connected rotary valves 110 and 210 is depicted in FIGS. 4–7. Each valve 110 and 210 includes essentially the same components as the valve 10 described above. The second tube connectors 150B and 250B have the same straight sidewall 154 and 254 as the valve 10 described above. However, the first, third and fourth tube connectors 150A, 150C, 150D, 250A, 250C and 250D in the connected valves 110 and 210 depicted in the drawings have curved sidewalls 154A, 154C, 154D, 254A, 254C and 254D. The curved sidewalls 154A, 154C, 154D, 254A, 254C and 254D allow the valves 110 and 210 to be located close to each other.

Figure 4:
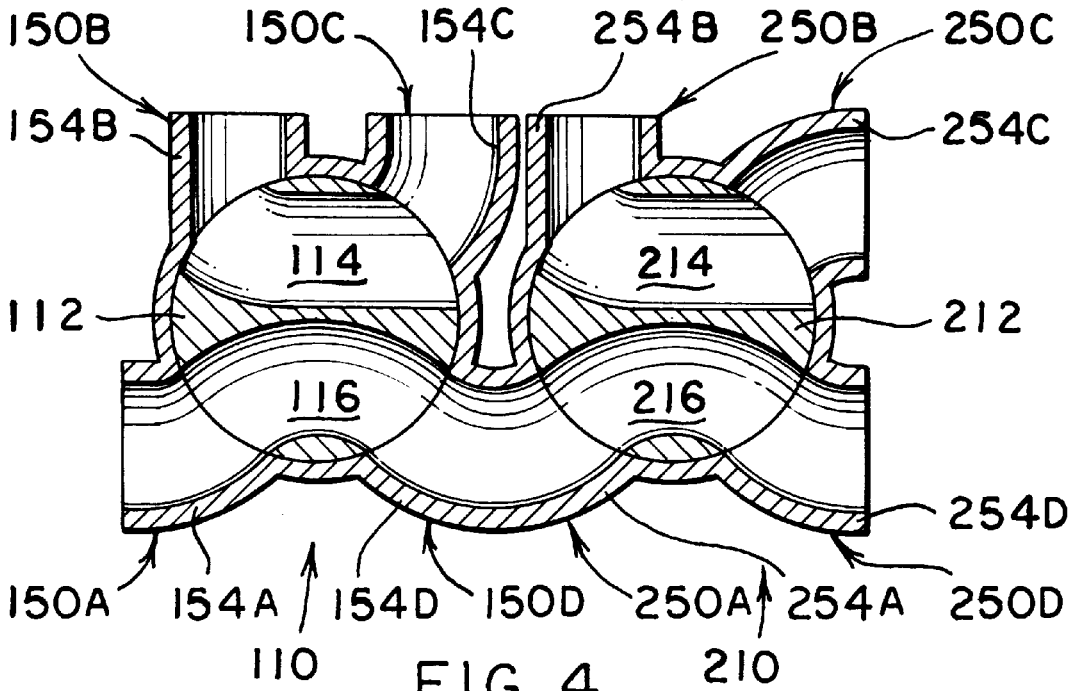
FIG. 4 is a cross sectional side view of two rotary valves according to the present invention connected in series with the rotors of both valves in an unactuated position.

When both rotors 112 and 212 are in the unactuated position as shown in FIG. 4, no additional loops are included in the soundpath and the sound passing through the valves 110 and 210 is only subjected to limited turning. As such the second duct 116 turns the sound approximately 90 degrees and the second duct 216 turns the sound approximately 90 degrees.

Figure 5:
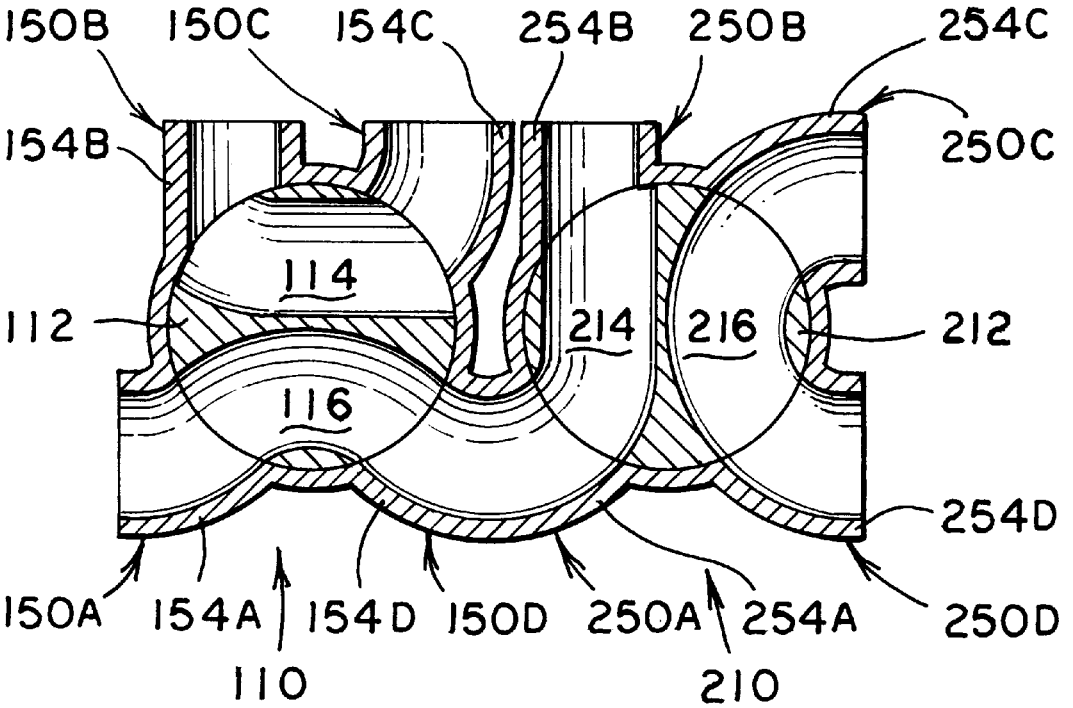
FIG. 5 is a cross sectional side view of the valves in FIG. 4, the first valve being in an unactuated position, the second valve being in an actuated position.
Figure 6:
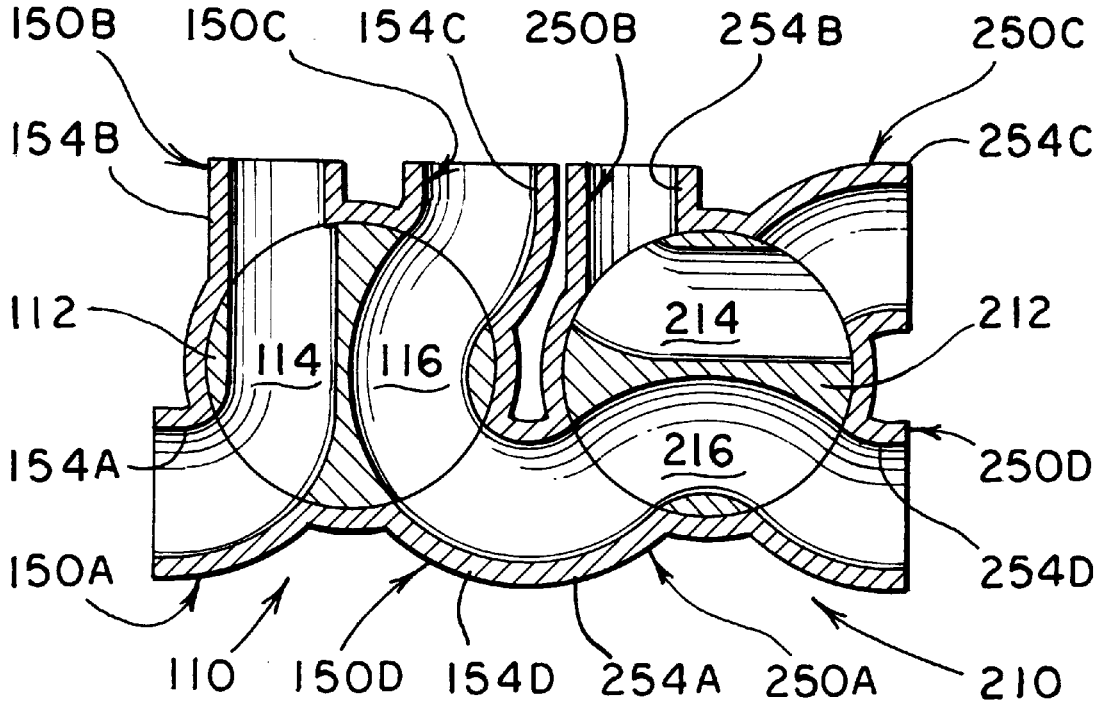
FIG. 6 is a cross sectional side view of the valves in FIG. 4, the first valve being in an actuated position, the second valve being in an unactuated position.

When the musician desires to add one loop into the soundpath, the musician may either actuate the first valve 110 or the second valve 210, as shown in FIGS. 5 and 6. The instrument designer may vary the length of the additional loops such that the first valve 110 may add a long loop when actuated and the second valve 210 may add a short loop in the actuated position. It is to be noted that because the second sidewalls 154B and 254B are straight, the actuated positions of the valves 110 and 210 have less acoustic impedance than those valves having curved sidewalls. In either position, the sound moving through the valves 110 and 210 is only subjected to two 90 degree turns and a single 45 degree turn.

Figure 7:
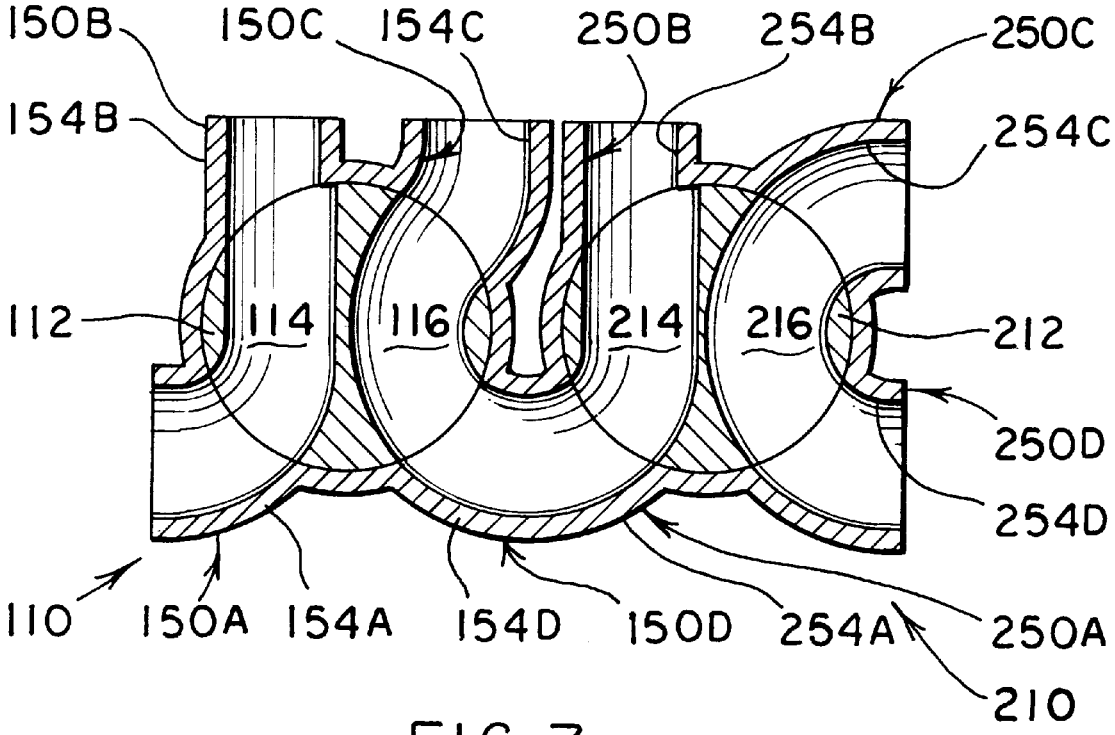
FIG. 7 is a cross sectional side view of the valves in FIG. 4, the rotors of both valves being in the actuated position.

If the musician desires to add both loops to the soundpath, the musician actuates both valves 110 and 210 as shown in FIG. 7. In this position, the longest possible soundpath for the two valves 110 and 210 is achieved. As such, the sound experiences two 90 degree turns and two 45 degree turns in the confines of the 5 valves 110 and 210. The first 45 degree turn occurs as the sound passes through the first duct 114 of the first valve 110. The sound is then subjected to the various turns that may occur in the additional length of tubing (not shown). When the sound returns to the first valve 110, the sound is subjected to the first 90 degree turn in the second duct 116 of the first valve 110. After the sound leaves the second duct 116, the sound passes through the tube connectors 150D and 250A that connect the two valves 110 and 210. The tube connectors 150D and 250A are curved in the example depicted and add an additional turn to the overall soundpath. This additional turn, however, is not inside the body of the valves 110 and 210. The sound then experiences the second 45 degree turn in the first duct 214 of the second valve 210 and the second 90 degree turn in the second duct 216 of the second valve 210.

While only a preferred embodiment of the present invention is disclosed, it is to be clearly understood that the same is susceptible to numerous modifications apparent to one skilled in the art. Therefore, the scope of the present invention is not to be limited to the details shown and described but is intended to include all changes and modifications which come within the scope of the appended claims and their equivalents.

As should now be apparent, the present invention not only provides a rotary valve capable of providing constant diameter, low curvature soundpaths, but also demonstrates that the other objects of the invention are likewise accomplished.

I claim:

1. A rotary valve for a brass wind instrument, comprising.

a casing;

four tube connectors attached to said casing, each of said rube connectors having a passageway therethrough having first and second ends, said first end being a port;

each of said passageways having a constant cross section;

a rotor rotatably disposed in said casing;

said rotor having first and second ducts;

each of said first and second ducts having a constant cross section;

said cross sections of said passageways being equal to said cross sections of said ducts;

said rotor being selectively rotatable between an unactuated position and an actuated position;

said first duct being configured to fluidly connect a first pair of said passageways when said rotor is in said actuated position;

said first duct forming a 45 degree soundpath through the rotor when said rotor is in said actuated position;

said second duct being configured to fluidly connect a second pair of said passageways when said rotor is in said actuated position; and said second duct being configured to connect a third pair of said passageways when said rotor is in said unactuated position.

2. A rotary valve according to claim 1, wherein:

said tube connectors are attached to said casing in a fluid-tight connection;

each of said passageways passing through said casing at said second end of said passageway; and said rotor being configured to selectively form fluid-tight connections between said ducts and said passageways.

3. A rotary valve according to claim 1, wherein:

said first duct has a curved section and a straight section; and said second duct is continuously curved.

4. A rotary valve according to claim 1 wherein said constant cross section of said ducts is circular.

5. A rotary valve for a brass wind instrument, comprising:

a casing;

first, second, third, and fourth tube connectors attached to said casing;

each of said tube connectors forming a fluid-tight connection with said casing;

said first, second, third, and fourth tube connectors having a first, second, third, and fourth passageway respectively therethrough;

a rotor rotatably disposed in said casing;

said rotor having first and second ducts therethrough;

said rotor being selectively rotatable between actuated and unactuated positions;

said first duct connecting said first and second passageways when said rotor is in said actuated position to form a first of two actuated soundpaths;

said second duct connecting said third and fourth passageways when said rotor is in said actuated position to form a second of two actuated sound paths;

said second duct connecting said first and fourth passageways when said rotor is in said unactuated position to form a single unactuated sound path; and said first duct being turned 45 degrees.

6. A rotary valve according to claim 5, wherein:

said first duct comprises a curved section and a straight section; and said curved section turning said actuated soundpath 45 degrees.

7. A rotary valve according to claim 5, wherein:

each of said ducts has a constant cross section; and each of said passageways has a constant cross section substantially equal to said cross section of said ducts.

8. A rotary valve according to claim 7 wherein said cross sections of said ducts and said passageways are circular.

9. A valve assembly comprising:

first and second rotary valves;

said first rotary valve comprising a rotor having first and second ducts therethrough, said rotor rotatable between an actuated and an unactuated position;

said second rotary valve comprising a rotor having first and second ducts therethrough, said rotor rotatable between an actuated and an unactuated position;

each of said rotary valves further comprising four tube connectors having passageways therethrough;

each of said rotors being configured to selectively form fluid-tight connections between said ducts and said passageways;

one of said tube connectors of said first valve being connected to one of said tube connectors on said second valve;

each rotor forms two actuated soundpaths through the valve when the rotor is in the actuated position and a single unactuated soundpath when the rotor is in the unactuated position;

said single unactuated soundpath turning 90 degrees;

one of said two actuated soundpaths turning 45 degrees; and the other of said two actuated soundpaths turning 90 degrees.

10. A valve assembly according to claim 9, wherein sound traveling through the valve assembly is subjected to at least two 90 degree turns.

11. A valve assembly according to claim 9, wherein sound traveling through the valve assembly is subjected to two 90 degree turns and two 45 degree turns when both of said valves are in said actuated position.

* * * * *